US005174226A

United States Patent [19]

Martin et al.

[11] Patent Number: 5,174,226

[45] Date of Patent: Dec. 29, 1992

[54] PROCESS AND A JET FOR DELIVERING SECONDARY AIR

[75] Inventors: Walter J. Martin, Tegernsee; Johannes J. E. Martin, Seeshaupt, both of Fed. Rep. of Germany

[73] Assignee: Martin GmbH Für Umwelt-und Energietechnik, Munich, Fed. Rep. of Germany

[21] Appl. No.: 821,495

[22] Filed: Jan. 15, 1992

[30] Foreign Application Priority Data

Jan. 24, 1991 [DE] Fed. Rep. of Germany ..... 4102072

[51] Int. Cl.[5] ..... F23L 9/00

[52] U.S. Cl. ..... 110/297; 110/314; 110/318; 239/299

[58] Field of Search ..... 110/348, 299, 300, 291, 110/297, 313, 314; 239/290, 296, 299, 553.5

[56] References Cited

U.S. PATENT DOCUMENTS

| | | | |
|---|---|---|---|
| 2,956,527 | 10/1980 | Hopwood | 110/313 |
| 3,955,512 | 5/1976 | Martin et al. | 110/255 X |
| 4,495,872 | 1/1985 | Shigaki | 110/190 |
| 4,917,026 | 4/1990 | Greenough | 110/297 |

*Primary Examiner*—Edward G. Favors
*Attorney, Agent, or Firm*—McAulay Fisher Nissen Goldberg & Kiel

[57] ABSTRACT

The secondary air jets (11) that are arranged within the combustion space (5) consist of an outer casing (12), an inner casing (13), and a flange (14) that connects the two casings to each other, the flange (14) crossing the inner casing (13) and being rigidly connected with this, whereas the outer casing (12) is so connected to the flange that is of greater diameter than the outer casing (12) that slot-type jets (15) are left between the face side of the outer casing (12) and the flange (14), these jets making it possible to expel air parallel to the defining wall and essentially perpendicular to the axis of the jets.

6 Claims, 3 Drawing Sheets

PROCESS AND A JET FOR DELIVERING SECONDARY AIR

BACKGROUND OF THE INVENTION

1. Filed of the Invention

The present invention relates to a process for introducing secondary air into a furnace with a mechanical fire grate, through which primary air is introduced, and above this, a combustion space that is defined by side walls in which secondary air is injected by means of jets that are arranged at least in the front and rear defining walls. The present invention also relates to a jet for carrying out this process.

2. Background Art

In furnaces that incorporate the delivery of secondary air into the combustion space by means of jets, when the jets are preferably arranged on the front and rear walls, very frequently particles of fuel are baked on in the area of one defining wall that is located beneath an opposite secondary air jet, by which they are thrown against the opposite wall, to which they adhere because of the fact that these particles of fuel are still incandescent and able to flow. Such encrustations can only be removed with great difficulty and require that the whole furnace be shut down, which is connected with a long period of downtime. In the case of furnaces with a reversed feed grate, the encrustations occur on the rear defining wall because its lower wall area is exposed to the radiation effect of the secondary air jet in the front defining wall because of the way the combustion space is constructed.

OBJECT AND SUMMARY OF THE INVENTION

It is an object of the present invention to prevent these encrustations from forming on a defining wall or a plurality of such walls of the combustion space.

In accordance with the present invention, in a process for supplying secondary air to a furnace with a mechanical fire grate, through which primary air is introduced, and a combustion space that is arranged over this and defined by walls, into which secondary air is injected by means of jets that are arranged at least in the front and rear defining walls, the improvement comprising: on at least one defining wall which is in the area that is acted upon by an opposing secondary air feed, dividing the secondary air so that one part is directed into the combustion space and a second part is directed parallel to the defining wall.

Because of the division of the secondary air into one part that is directed into the combustion space and another part that is parallel to the defining wall, the latter forms a screen on the defining wall that is able to trap some of the fuel particles so that these cannot strike the defining wall. To the extent that this is not possible because the particles possess too much kinetic energy, the fuel particles will at least be cooled to the point that they no longer adhere to the defining wall. This simple measure thus serves to remedy a serious problem that up to now has had serious consequences, as has been described heretofore.

A jet that is used to carry out the process is characterized in that it incorporates an outer casing that tapers conically in the direction of flow, a cylindrical inner casing, and a flange that holds the two casings concentrically relative to each other and connects them rigidly to each other; this flange crosses the inner casing and is of a diameter that extends beyond the outer casing at its end that is proximate to the flange; and in that the outer casing is secured at its face end to the flange; and in that at least one area of the periphery is configured as a face end slot-type jet between the outer casing and the flange. As a result of this configuration, by using simple constructional means, it is possible to achieve a purposeful and reliable division of the secondary air into one part that is directed into the combustion space and into a second part that extends parallel to the defining wall as a screen.

In most applications, it is sufficient if, in the case of a plurality of slot nozzles, these are formed opposite each other and, in the case of only two nozzles, that these be located in the upper and the lower sections of the periphery.

In order to ensure the reliable division of the secondary air within the jet in such a manner that one part emerges into the combustion space perpendicular to the defining wall and the other part of the secondary air runs parallel to the defining walls, in a further development of the present invention the inside casing is shorter than the outside casing and is of a length that is between three times and six times the diameter of the inner casing.

In order to effect the division of the secondary air within the nozzle, as far as possible without any interference, in a further configuration of the present invention the end of the inside casing that is located within the outside casing is configured as a knife edge, with an inside diameter that increases towards the outside, and with a constant outside diameter.

BRIEF DESCRIPTION OF THE DRAWINGS

The present invention will be described in greater detail below on the basis of an embodiment shown in the drawings appended hereto. These drawings show the following.

DESCRIPTION OF THE PREFERRED EMBODIMENTS

Figure 1:
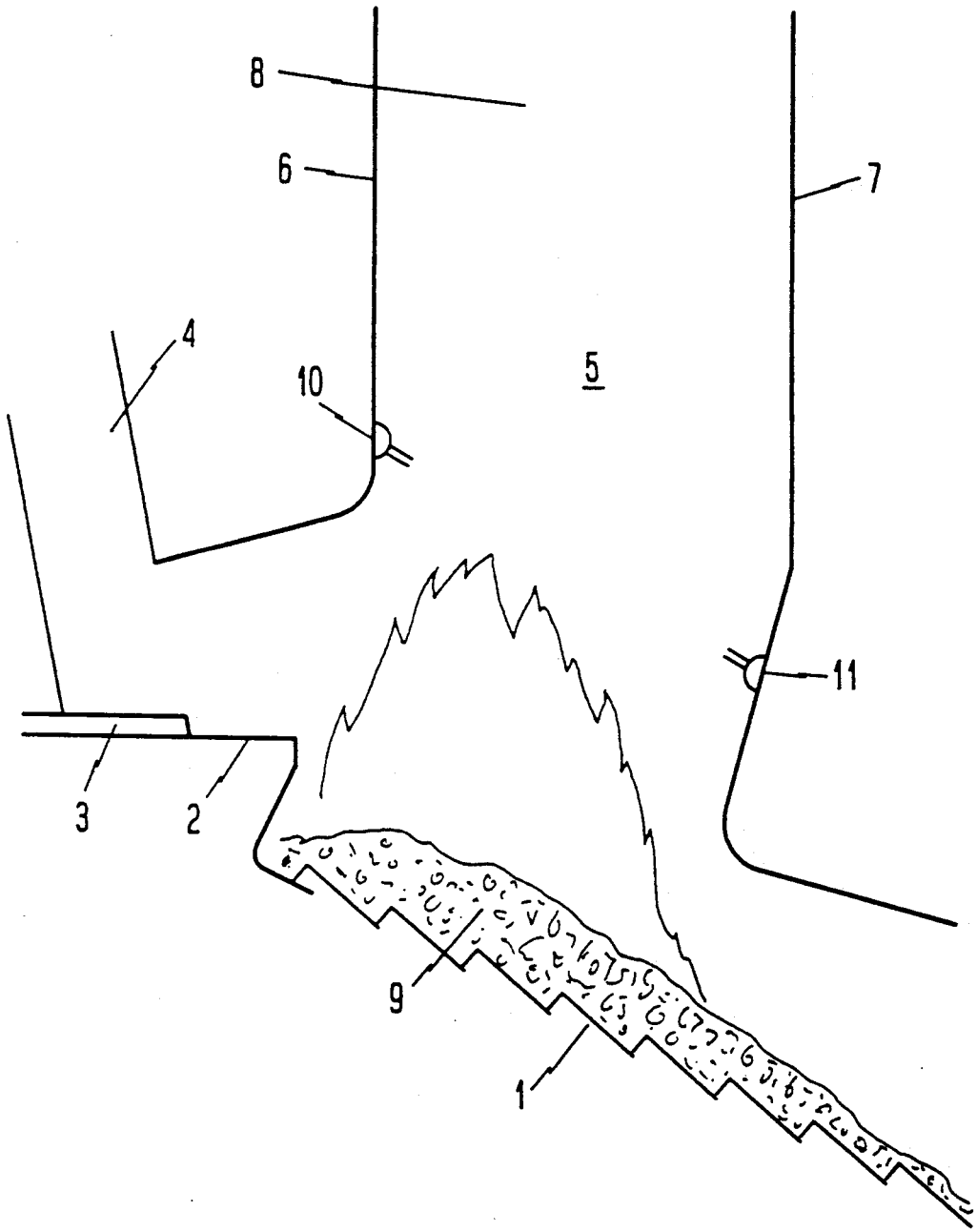
FIG. 1: a partial longitudinal section through the combustion space of a furnace.

FIG. 1 is a diagrammatic view of a section of a furnace that incorporates a fire grate 1 and a feeding disk 2 with feed rams 3 that push the fuel that is delivered through the feed chute 4 onto the fire grate. The combustion space 5 that extends upwards is formed above the fire grate, in its first section, and this is defined by a front wall 6, a rear wall 7, and side walls 8. Primary combustion air is fed to the fuel that lies on the grate 1 from below, through the grate. Because of the fact that unburned particles are carried upwards by the rising gases, it is preferred that there are secondary air nozzles 10 and 11 incorporated in the area of the front defining walls 6 and in the area of the rear defining walls 7, and these inject additional combustion air into the combustion space in order to subject the unburned particles that rise upwards through the combustion space to further combustion.

Because, in the past, it has been shown the unburned fuel that is present in the rising gases is thrown against the rear defining walls 7, where they will adhere, because of the jets 10 that are located in the area of the front defining wall, the secondary air jets 11 in the rear defining wall are so configured that these encrustations are prevented by way of a special supply of air.

Figure 2:
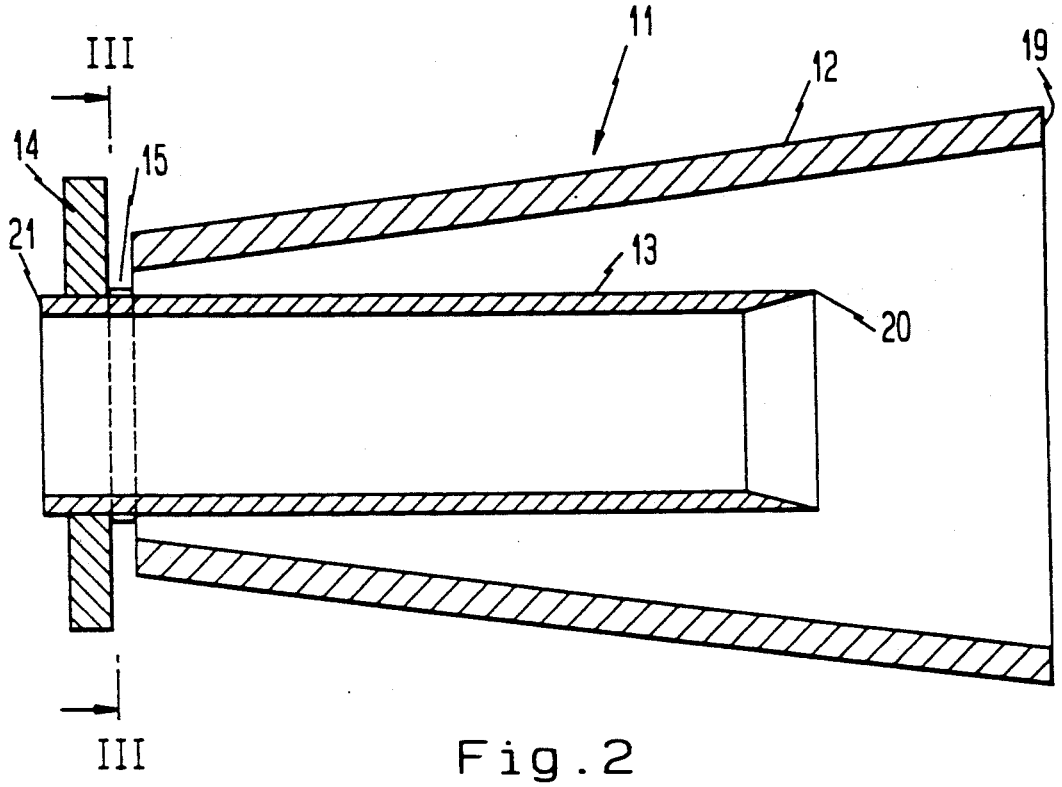
FIG. 2: a longitudinal section through a first embodiment of a secondary air jet.
Figure 3:
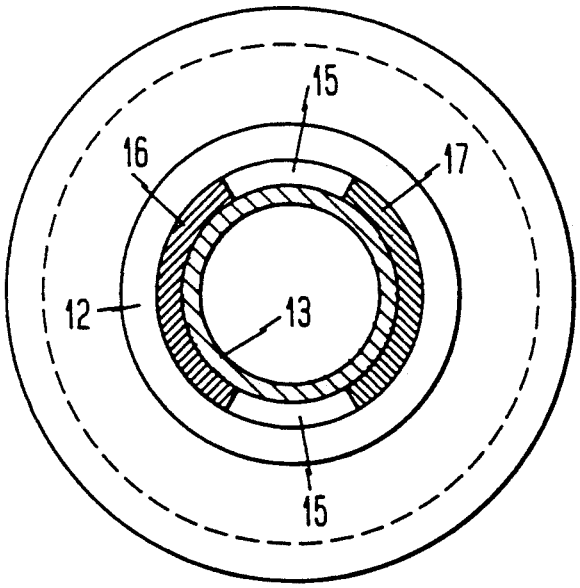
FIG. 3: a section on the line III—III in FIG. 2.

To this end, as is shown in FIGS. 2 and 3, the secondary air jet, consists of an outer casing 12 and an inner casing 13 that a flange 14 crosses and to which it is rigidly connected, e.g., by welding. At its face end, the outer casing 12 is connected to the flange 14, this being done by interposing two arc-shaped spacers 16 and 17, which are rigidly connected on the one hand to the flange 14 and, on the other hand, to the face side of the outer casing 12, which means that slot-shaped jets 15 are left between the two spacers, between the face side of the outer case 12 and the flange 14, air being able to escape through these, said air being supplied by means of a feed line (not shown herein) that is connected to the end 19 of the outer casing 12. This air is split into two parts by the inner casing 13 which, at its end that is within the outer casing 12, incorporates a knife edge 20; one part of this secondary air flows within the inner casing 13 and out of its unobstructed end 21 and into the combustion space, where it emerges perpendicular to the defining wall 7, whereas the other part of the air flows between the outer surface of the inner casing 13 and the inner surface of the outer casing 12 to the slot-like jets 15 between the face side of the outer casing 12 and the flange 14, where it flows out essentially parallel to the rear defining wall 7 from the secondary air jet 11 and expands in the manner of a screen parallel to the defining wall. Because of this air that emerges between the face side of the outer casing 12 and the flange 14, which protrudes beyond the outside diameter of the outer flange at this point, any encrustation of combustible particles on the defining wall 7 of the combustion space is avoided.

Figure 4:
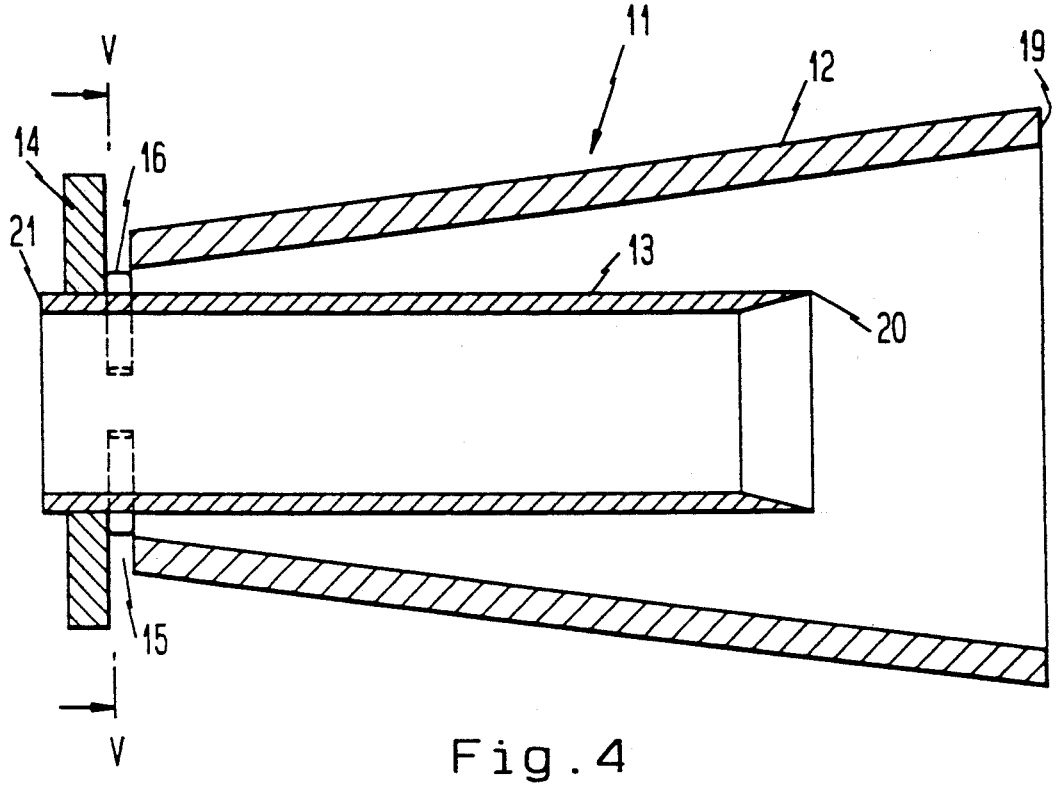
FIG. 4: a longitudinal section through a second embodiment of a secondary air jet.
Figure 5:
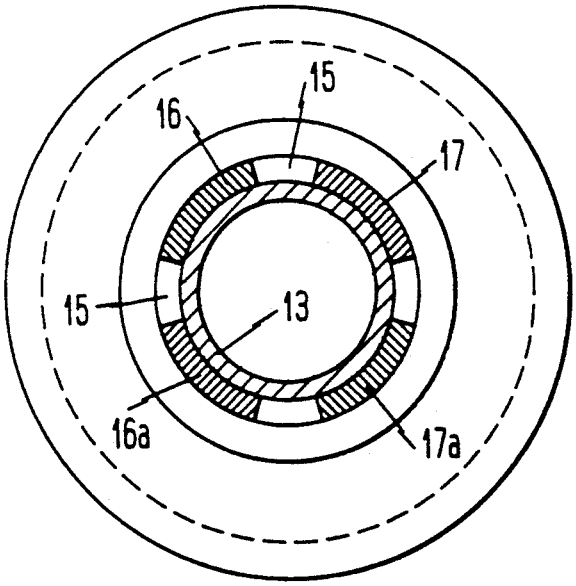
FIG. 5: a cross section on the line V—V in FIG. 4.

The secondary air jet shown in FIGS. 4 and 5 is essentially the same as that shown in FIGS. 2 and 3, so that identical parts bear the same reference numbers. The only difference is that in the secondary air jet shown in FIGS. 4 and 5, there are four spaces 16, 16*a*, 17, 17*a* between the flange 14 and the outer casing 12, so that four opposing jets 15 are formed.

While the foregoing description and drawings represent the preferred embodiments of the present invention, it will be obvious to those skilled in the art that various changes and modifications may be made therein without departing from the true spirit and scope of the present invention.

We claim:

1. In a process for supplying secondary air to a furnace with a mechanical fire grate, through which primary air is introduced, and a combustion space that is arranged over this and defined by walls, into which secondary air is injected by means of jets that are arranged at least in the front and rear defining walls, the improvement comprising: on at least one defining wall which is in the area that is acted upon by an opposing secondary air feed, dividing the secondary air so that one part is directed into the combustion space and a second part is directed parallel to the defining wall.

2. A jet for carrying out a process for supplying secondary air to a furnace with a mechanical fire grate, through which primary air is introduced and a combustion space that is arranged over this and defined by walls, into which secondary air is injected by means of jets that are arranged at least in the front and rear defining walls, the improvement comprising, on at least one defining wall which is in the area that is acted upon by an opposing secondary air feed, dividing the secondary air so that one part is directed into the combustion space and a second part is directed parallel to the defining wall, said jet comprising an outer casing that tapers conically in the direction of flow, a cylindrical inner casing, and a flange that holds the two casing concentrically relative to each other and connects them rigidly together, the flange encompassing the inner casing and being of a diameter that is greater than the diameter of the outer casing at the end of said outer casing that is closest to the flange; said outer casing being secured at its face to the flange, and at least one section of a periphery of said jet is configured as a slot-type jet between the outer casing and the flange.

3. A jet as defined in claim 2, wherein a plurality of slot-type jets are employed in said process which are configured so as to be opposite each other.

4. A jet as defined in claim 2, wherein the inner casing is shorter than the outer casing and is of a length that is between three and six times the diameter of the inner casing.

5. A jet as defined in claim 2, wherein the end of the inner casing that is located within the outer casing is configured as a knife edge, with an inside diameter that grows wider towards the outside and with a constant outside diameter.

6. A jet as defined in claim 2, wherein two jets are employed in the process which are arranged in upper and lower sections of the periphery of the outer casing.

* * * * *